US011245233B2

(12) United States Patent
Lai et al.

(10) Patent No.: US 11,245,233 B2
(45) Date of Patent: Feb. 8, 2022

(54) CABLE CONCENTRATOR AND ELECTRONIC DEVICE HAVING THE SAME

(71) Applicant: GIGA-BYTE TECHNOLOGY CO., LTD., New Taipei (TW)

(72) Inventors: Chih-Ming Lai, New Taipei (TW); Yung-Shun Kao, New Taipei (TW)

(73) Assignee: GIGA-BYTE TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/936,261

(22) Filed: Jul. 22, 2020

(65) Prior Publication Data

US 2021/0351549 A1 Nov. 11, 2021

(30) Foreign Application Priority Data

May 6, 2020 (TW) ..... 109114988

(51) Int. Cl.

| | |
|---|---|
| ***H01R 12/00*** | (2006.01) |
| ***H01R 13/6585*** | (2011.01) |
| ***H01R 12/71*** | (2011.01) |
| ***H01R 13/518*** | (2006.01) |

(52) U.S. Cl.

CPC ..... *H01R 13/6585* (2013.01); *H01R 12/716* (2013.01); *H01R 13/518* (2013.01)

(58) Field of Classification Search

CPC .... H01R 12/71; H01R 12/712; H01R 12/716; H01R 13/518; H01R 13/6585

USPC ..... 439/78–80

See application file for complete search history.

(56) References Cited

U.S. PATENT DOCUMENTS

| | | | | |
|---|---|---|---|---|
| 10,784,603 | B2 * | 9/2020 | Lloyd | H01R 12/714 |
| 10,903,593 | B2 * | 1/2021 | Beaman | H01R 13/518 |
| 2019/0027870 | A1 | 1/2019 | Lloyd et al. | |

FOREIGN PATENT DOCUMENTS

| | | | |
|---|---|---|---|
| TW | M523220 | U | 6/2016 |
| TW | 201729477 | A | 8/2017 |

OTHER PUBLICATIONS

TW Office Action in Application No. 109114988 dated Nov. 23, 2020.

* cited by examiner

*Primary Examiner* — Khiem M Nguyen
(74) *Attorney, Agent, or Firm* — Maschoff Brennan

(57) ABSTRACT

The disclosure relates to a cable concentrator and an electronic device having the same, where the cable concentrator includes main body and ground partition plate. The main body includes sidewall portions and bottom plate portion together forming accommodation portion to accommodate cable connectors. The bottom plate portion has positive terminal holes and negative terminal holes. The ground partition plate is located in the accommodation portion and divides the accommodation portion. The ground partition plate has ground bent tabs respectively corresponding to the negative terminal holes of the bottom plate portion and are electrically connected to negative terminals on a circuit board and thus grounding the negative terminals.

19 Claims, 7 Drawing Sheets

CABLE CONCENTRATOR AND ELECTRONIC DEVICE HAVING THE SAME

CROSS-REFERENCE TO RELATED APPLICATIONS

This non-provisional application claims priority under 35 U.S.C. § 119(a) on Patent Application No(s). 109114988 filed in Taiwan (ROC) on May 6, 2020, the entire contents of which are hereby incorporated by reference.

TECHNICAL FIELD

The disclosure relates to a cable concentrator, more particularly to a cable concentrator having a ground partition plate and an electronic device having the same.

BACKGROUND

With the advancement of technology, electronic products, such as computers or servers, have more and more complex circuit layouts. These circuits are arranged over areas within the internal space and may include signal lines connected between the main power supply, speakers, light-emitting devices, and circuit boards, etc.

The internal space is typically very limited, thus during the assembly process, it is difficult for assembler to correctly install the signal lines to specific terminals on the same circuit board. And, after the installation of the signal lines, there will be signal interferences occurring between these signal lines and required to be reduced or removed, or which will affect the quality of single transmission.

SUMMARY

Accordingly, the present disclosure provides a cable concentrator and an electronic device having the same that enable an easy installation of signal lines and are able to solve the signal interferences among the signal lines.

One embodiment of the disclosure provides an electronic device configured for insertion of a plurality of cable connectors. The electronic device includes a circuit board, a container and a cable concentrator. The circuit board includes a plurality of positive terminals and a plurality of negative terminals. The container is disposed on the circuit board and has an accommodation space. The positive terminals and the negative terminals are located in the accommodation space. The cable concentrator includes a main body and a ground partition plate. The main body is detachably disposed in the accommodation space. The main body includes a plurality of sidewall portions and a bottom plate portion. The sidewall portions are connected to the bottom plate portion. The plurality of sidewall portions and the bottom plate portion together form an accommodation portion configured to accommodate the plurality of cable connectors. The bottom plate portion has a plurality of positive terminal holes respectively for insertions of the plurality of positive terminals and a plurality of negative terminal holes respectively for insertions of the plurality of negative terminals. The ground partition plate is located in the accommodation portion and includes a partition portion and a plurality of ground bent tabs. The partition portion divides the accommodation portion of the main body. The ground bent tabs are connected to a side of the partition portion. The ground bent tabs respectively correspond to the plurality of negative terminal holes of the bottom plate portion and are electrically connected to the plurality of negative terminals, grounding the plurality of negative terminals.

Another embodiment of the disclosure provides a cable concentrator configured for insertion of a plurality of cable connectors. The cable concentrator includes a main body and a ground partition plate. The main body includes a plurality of sidewall portions and a bottom plate portion. The sidewall portions are connected to the bottom plate portion. The plurality of sidewall portions and the bottom plate portion together form an accommodation portion configured to accommodate the plurality of cable connectors. The bottom plate portion has a plurality of positive terminal holes and a plurality of negative terminal holes. The ground partition plate is located in the accommodation portion and includes a partition portion and a plurality of ground bent tabs. The partition portion divides the accommodation portion of the main body. The ground bent tabs are connected to a side of the partition portion and respectively correspond to the plurality of negative terminal holes of the bottom plate portion.

According to the cable concentrator and the electronic device having the same as discussed in the above embodiments, the cable connectors can be installed in the cable concentrator and then electrically connected to the terminals on the circuit board along with the cable concentrator, which greatly improves the convenience of signal line installation. Also, in the cable concentrator, the ground partition plate not only can divide the accommodation portion of the main body and separate and support the cable connectors but also have ground bent tabs corresponding to the negative terminal holes formed on the main body to ground the negative terminals of the circuit board, thereby reducing or eliminating the signal interference among the cable connectors and therefore further improving the quality of signal transmission.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

Figure 1:
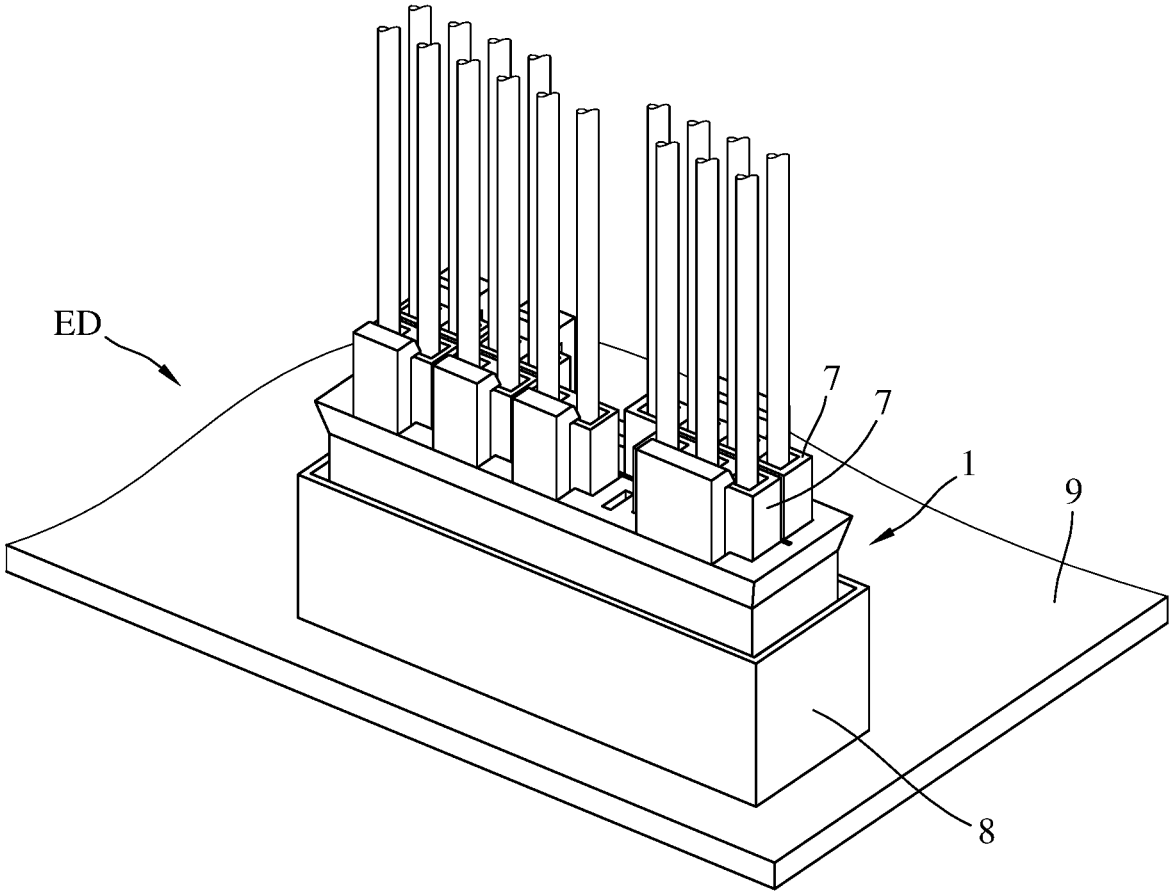
FIG. 1 is a partial perspective view of an electronic device having a cable concentrator according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details.

In addition, for the purpose of simple illustration, well-known features may be drawn schematically, and some unnecessary details may be omitted from the drawings. And the size or ratio of the features in the drawings of the present disclosure may be exaggerated for illustrative purposes, but the present disclosure is not limited thereto. Note that the actual size and designs of the product manufactured based on the teaching of the present disclosure may also be properly modified according to any actual requirement.

Further, as used herein, the terms "end", "part", "portion" or "area" may be used to describe a technical feature on or between component(s), but the technical feature is not limited by these terms. In addition, unless otherwise specified, the term "substantially", "approximately" or "about" may be used herein to provide an industry-accepted tolerance to its corresponding term without resulting in a change in the basic function of the subject matter at issue.

Furthermore, unless otherwise defined, all the terms used in the disclosure, including technical and scientific terms, have their ordinary meanings that can be understood by those skilled in the art. Moreover, the definitions of the above terms are to be interpreted as being consistent with the technical fields related to the disclosure. Unless specifically defined, these terms are not to be construed as too idealistic or formal meanings.

Firstly, referring to FIG. 1, one embodiment of the disclosure provides an electronic device ED configured for insertions of and having electrical connection with a plurality of cable connectors 7. The cable connectors 7 are, for example, connectors of signal lines. Note that the disclosure is not limited to the quantity and type of the cable connectors 7 that the electronic device ED can support. And note that the "plurality" used herein may refer to including two or more quantities. In the electronic device ED, the cable connectors 7 can be concentrated into one or more bundles before being electrically connected to the circuit board 9, which facilitates the process of installing the cable connectors 7 onto the circuit board 9.

Figure 2:
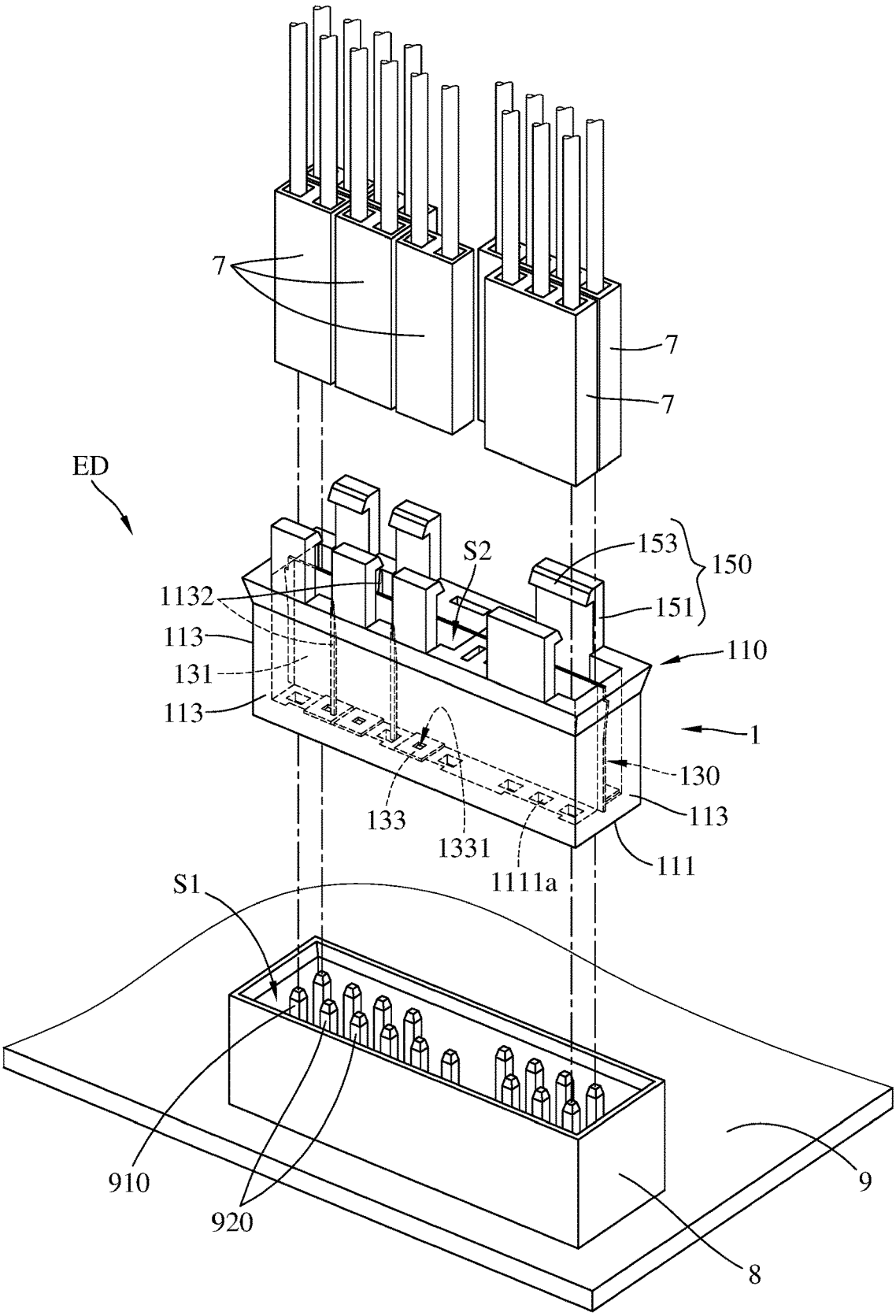
FIGS. 2-3 are exploded views of the electronic device in FIG. 1.
Figure 3:
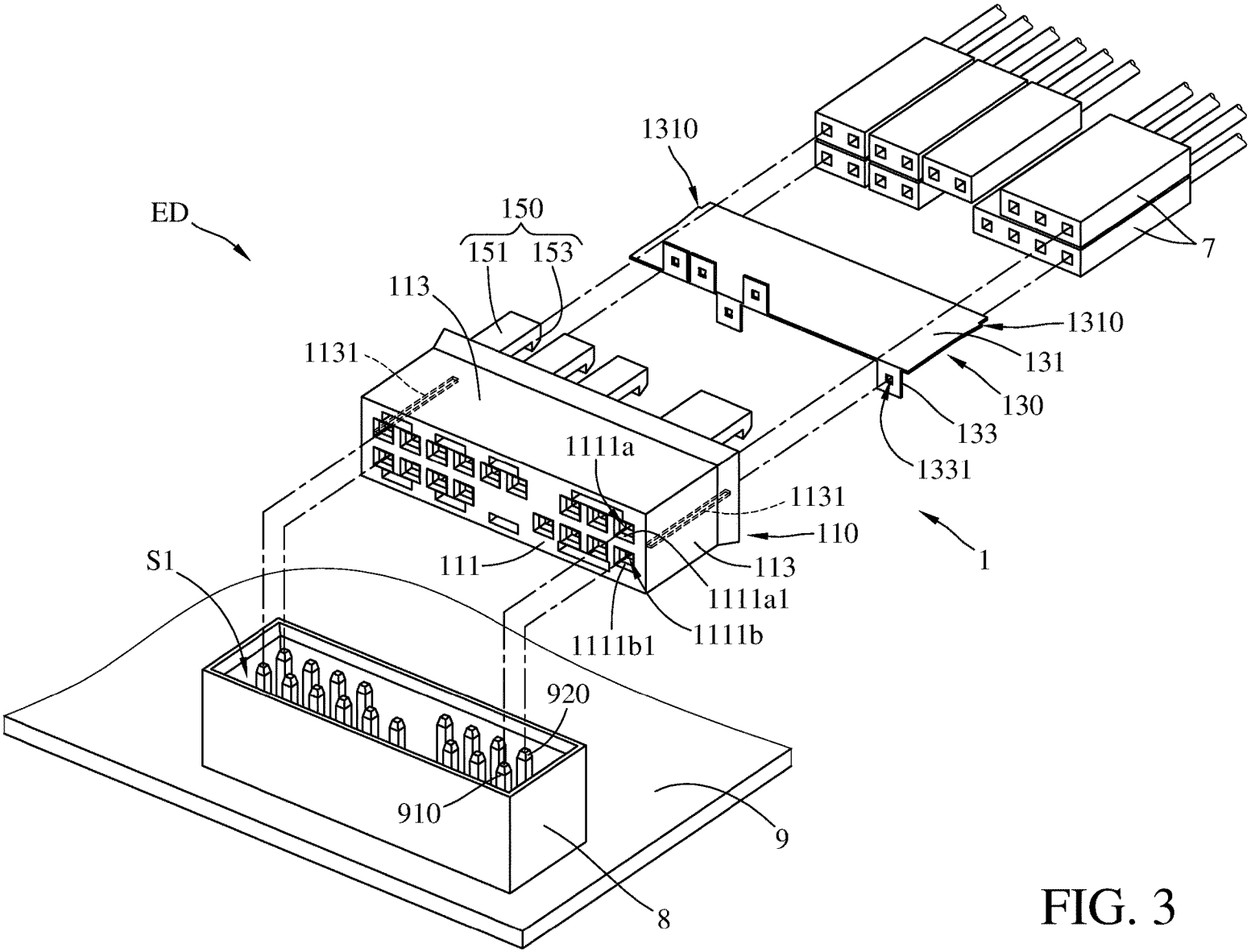
Figure 4:
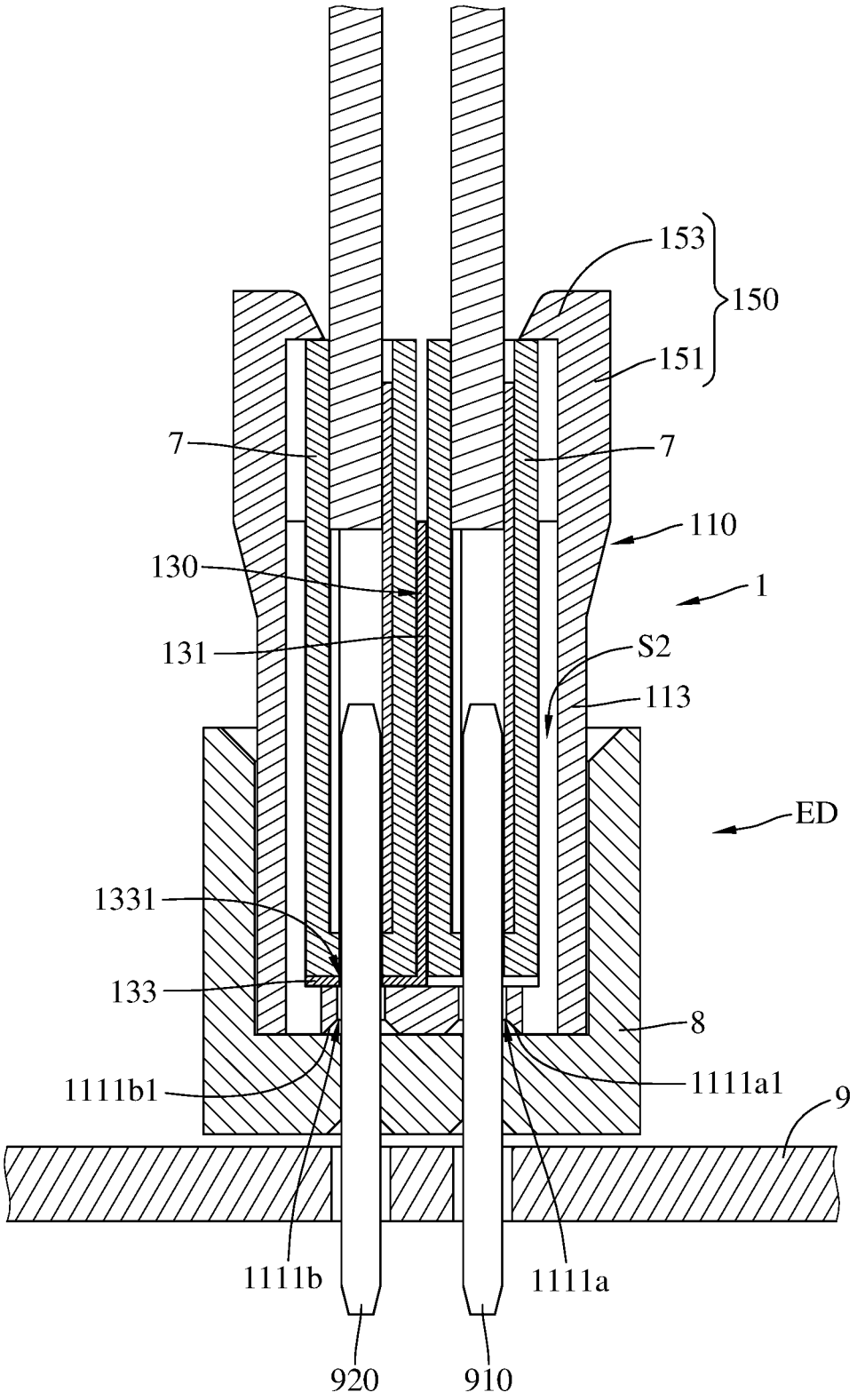
FIG. 4 is a cross-sectional side view of the electronic device in FIG. 1.

In detail, please further refer to FIGS. 2-4, wherein FIGS. 2-3 are exploded views of the electronic device ED, and FIG. 4 is a cross-sectional side view of the electronic device ED. In this embodiment, the electronic device ED may include the aforementioned circuit board 9, a container 8, and a cable concentrator 1. The circuit board 9 is a carrier for electronic components (not shown) required for the electronic products to which is applied. In one application, the circuit board 9 may be applied to the front panel of a computer or server, but the disclosure is not limited to the design of the circuit board 9, the electronic components on the circuit board 9, and the electronic products to which it is applied. In this embodiment, there may be a plurality of positive terminals 910 and a plurality of negative terminals 920 disposed on the circuit board 9, the positive terminals 910 and the negative terminals 920 respectively correspond to and are configured to electrically connect to the cable connectors 7. Note that the quantity and arrangement of the positive terminals 910 and the negative terminals 920 can be modified according to actual requirements, and the disclosure is not limited to this.

The container 8 is disposed on the circuit board 9. In this embodiment, the container 8 may be a frame surrounding the positive terminals 910 and the negative terminals 920. As shown, the container 8 may be a rectangular frame that can accommodate the positive terminals 910 and the negative terminals 920 in its accommodation space S1. The accommodation space S1 is configured to accommodate the cable concentrator 1, so its size and shape may be modified according to the configuration of the cable concentrator 1 or the arrangement of the positive terminals 910 and the negative terminals 920, and the disclosure is not limited to this.

As shown, the cable connectors 7 can be gathered into one or more bundles and then inserted into the cable concentrator 1, and then the cable concentrator 1 and the bundles of the cable connectors 7 are inserted into the accommodation space S1 of the container 8 together, by doing so, the cable connectors 7 can be correctly electrically connected to the corresponding positive terminals 910 and negative terminals 920.

In detail, in this embodiment, the cable concentrator 1 may include a main body 110, a ground partition plate 130, and a plurality of elastic holding arms 150. The main body 110 is, but not limited to, a single piece made of plastic. The main body 10 is configured to be removably accommodated in the accommodation space S1 of the container 8. The main body 110 may include a bottom plate portion 111 and a plurality of sidewall portions 113. The sidewall portions 113 respectively connect different sides of the bottom plate portion 111, and the sidewall portions 113 and the bottom plate portion 111 together form an accommodation portion S2 therebetween. The bundles of the cable connectors 7 can be gathered and inserted into the accommodation portion S2. In more detail, the bottom plate portion 111 of the main body 110 may have a plurality of through holes for terminals. Herein, for the purpose of illustration, the terminal through holes for the positive terminals 910 are called positive terminal holes 1111*a*, and the terminal through holes for the negative terminals 920 are called negative terminal holes 1111*b*. The quantities and arrangements of the positive terminal holes 1111*a* and negative terminal holes 1111*b* may match that of the positive terminals 910 and negative terminals 920 on the circuit board 9. Thus, when the main body 110 is accommodated in the accommodation space S1, the positive terminals 910 and the negative terminals 920 can be inserted through the corresponding positive terminal holes 1111*a* and negative terminal holes 1111*b*. In addition, two of the sidewall portions 113 of the main body 110 opposite to each other may each have a groove 1131. The grooves 1131 can guide the ground partition plate 130 during the installation of the ground partition plate 130 into the accommodation portion S2, ensuring that the ground partition plate 130 is installed into the accommodation portion S2 along a predetermined direction.

The ground partition plate 130 may include a partition portion 131 and a plurality of ground bent tabs 133. The partition portion 131 can be inserted into the accommodation portion S2 along the grooves 1131 of the sidewall portions 113 of the main body 110, dividing the accommodation portion S2 into two smaller space (not numbered) and thus dividing the cable connectors 7 located in the accommodation portion S2 into two groups. The partition portion 131 also can provide support to the groups of the cable connectors 7, preventing the cable connectors 7 from inclining towards each other. Considering the needs of miniaturization and the limitations of plastic molding, the partition portion 131 used to divide the accommodation portion S2 is suitable to be made of metal so that the partition portion 131 can be made with a desired small thickness. In addition, in order to securely fix the partition portion 131 in the accommodation portion S2, in this embodiment, two opposite sides of the partition portion 131, that abuts the grooves 1131, each have a protruding structure 1310, which can prevent the partition portion 131 from slipping out of the grooves 1131.

In this embodiment, the ground bent tabs 133 are, but not limited to, integrally formed with the partition portion 131.

The ground bent tabs 133 are connected to the same side of the partition portion 131 and are substantially perpendicular to the partition portion 131. The ground bent tabs 133 can be stacked on or above the bottom plate portion 111 of the main body 110 and can respectively correspond to the negative terminal holes 1111*b* configured for the insertions of the negative terminals 920. In this embodiment, the ground bent tabs 133 each have a through hole 1331, wherein the through holes 1331 respectively correspond to the negative terminal holes 1111*b* configured for the insertions of the negative terminals 920. Thus, when the cable concentrator 1 is accommodated in the accommodation space S1 of the container 8, the negative terminals 920 on the circuit board 9 can penetrate through the negative terminal holes 1111*b* of the bottom plate portion 111 of the main body 110 and the through holes 1331 of the ground bent tabs 133 of the ground partition plate 130, and the positive terminals 910 on the circuit board 9 can penetrate through the positive terminal holes 1111*a* of the bottom plate portion 111. The diameters of the through holes 1331 of the ground bent tabs 133 of the ground partition plate 130 may substantially smaller than that of the negative terminal holes 1111*b* of the bottom plate portion 111 of the main body 110, such as at least smaller than the outer diameter of the negative terminal 920, such that the insertion of the negative terminals 920 at the through holes 1331 make the negative terminals 920 directly contact and form electrical connection with the ground bent tabs 133. The diameter of the positive terminal holes 1111*a* of the bottom plate portion 111 of the main body 110 is not particularly limited and may be substantially larger than, equal to, or slightly smaller than the outer diameters of the positive terminals 910 or negative terminals 920 inserted in in.

In addition, as shown, in this or some other embodiments, the portion of the main body 110 that forms the positive terminal holes 1111*a* has a plurality of guiding inclined surfaces 1111*a*1 respectively at the ends of the positive terminal holes 1111*a* (especially refer to the portion near the outer surface of the bottom plate portion 111 and forming part of the positive terminal holes 1111*a*). The guiding inclined surfaces 1111*a*1 form the insertion openings of the positive terminal holes 1111*a* for the insertions of the positive terminals 910 and are inclined with respect to the outer surface of the bottom plate portion 111, such that the guiding inclined surfaces 1111*a*1 are able to guide the inserting of the positive terminals 910 into the positive terminal holes 1111*a*. Similarly, the portion of the main body 110 that forms the negative terminal holes 1111*b* has a plurality of guiding inclined surfaces 1111*b*1 respectively at the ends of the negative terminal holes 1111*b* (especially refer to the portion near the outer surface of the bottom plate portion 111 and forming part of the negative terminal holes 1111*b*0. The guiding inclined surfaces 1111*b*1 form the insertion openings of the negative terminal holes 1111*b* for the insertions of the negative terminals 920 and are inclined with respect to the outer surface of the bottom plate portion 111, such that the guiding inclined surfaces 1111*b*1 are able to guide the inserting of the negative terminals 920 into the negative terminal holes 1111*b*.

The elastic holding arms 150 may be integrally formed with the main body 110. The elastic holding arms 150 extend outwards from a side of the sidewall portions 113 away from the bottom plate portion 111. Thus, the height of the elastic holding arms 150 exceed the top surface of the sidewall portions 113. The elastic holding arms 150 may be made of elastic materials, such as plastic so that a certain external force can force the elastic holding arms 150 to produce a recoverable deformation. In more detail, in this embodiment, elastic holding arm 150 may each include an extension portion 151 and a holding portion 153, where the holding portion 153 is connected to the sidewall portion 113 of the main body 110 via the extension portion 151, and the holding portion 153 extends inwards from the ends of the extension portion 151 and therefore substantially extends towards another holding portion 153 on the opposite side. In this embodiment, the holding portion 153 may be in a hook shape. During the placement of the cable connector 7 into the accommodation portion S2 of the main body 110, the cable connector 7 pushes the holding portions 153 and deforms the extension portions 151. When the cable connector 7 reaches the required position in the accommodation portion S2, the cable connector 7 slips over the holding portions 153 and stop from pushing the holding portion 153 and deforming the extension portions 151, such that the elastic holding arms 150 return to their original positions to make the holding portions 153 stop at the side of the cable connector 7 facing away from the bottom plate portion 111 of the main body 110, as shown in FIG. 5, the cable connector 7 is held in the accommodation portion S2.

Note that the quantity of the elastic holding arms 150 may be modified according to actual requirements and does not intend to limit the disclosure. In addition, in some other embodiments, the cable concentrator may not have the aforementioned elastic holding arms 150; in such a case, the cable connector may be firmly fixed in the accommodation portion of the main body by tightly contacting the inner walls of the sidewall portions.

Figure 5:
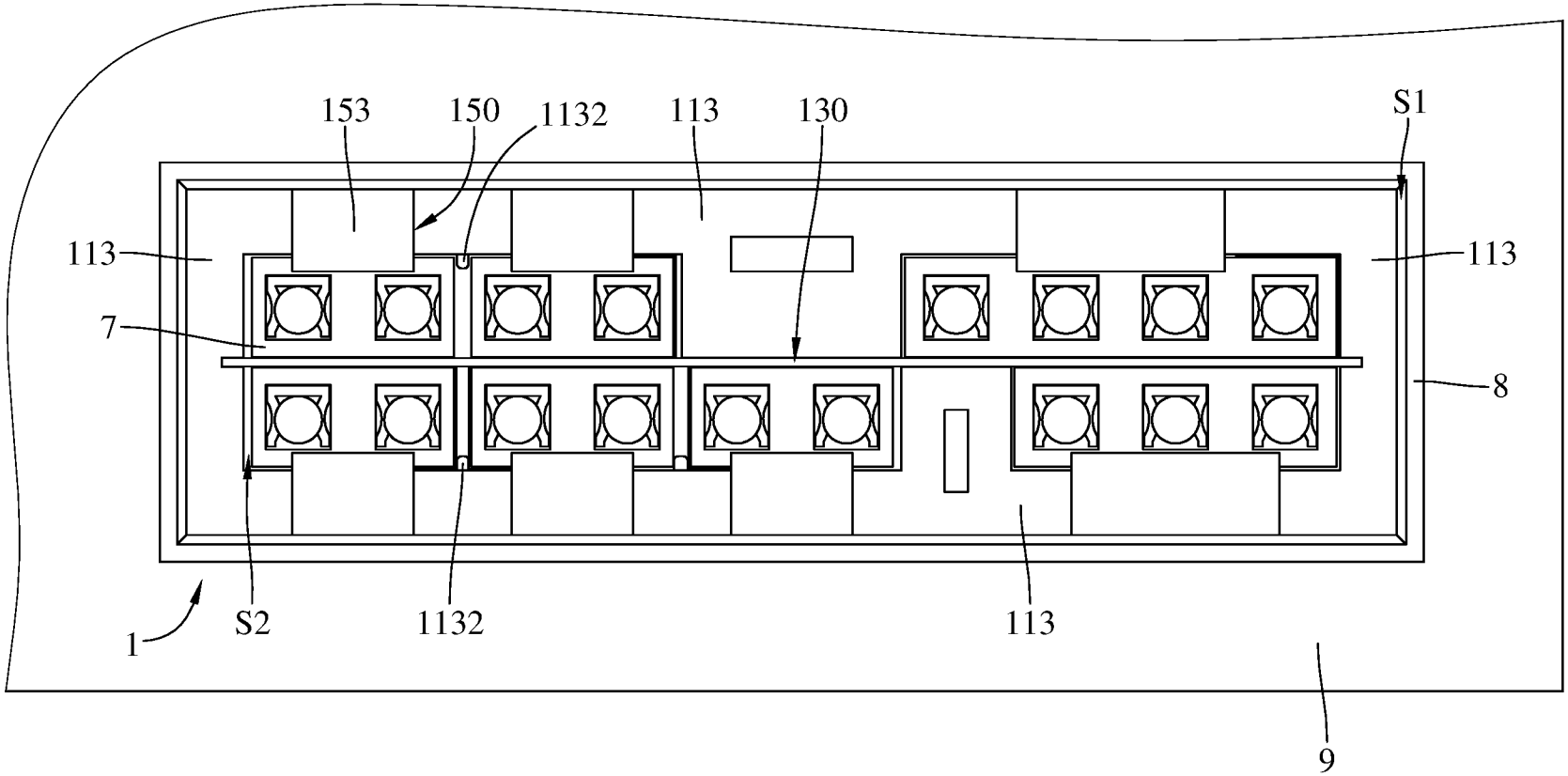
FIG. 5 is a top view of the electronic device in FIG. 1.

In addition, as shown in FIGS. 2 and 5, in this embodiment, some of the sidewall portions 113 of the main body 110 of the cable concentrator 1 have at least one rib 1132 protruding inwards and located in the accommodation portion S2 of the main body 110. The length of a part of or all of the ribs 1132 may be smaller than the height of the sidewall portions 113, that is, a part of or all of the ribs 1132 are shorter than the sidewall portions 113; in other words, the length of a part of or all of the ribs 1132 is smaller than the depth of the accommodation portion S2. As shown, at least one rib 1132 does not reach the bottom plate portion 111 and is spaced apart from the bottom plate portion 111. The ribs 1132 help properly separate the cable connectors 7 from one another during the placement of the cable connectors 7 and help maintain the cable connectors 7 in the main body 110 in positions aligned with the corresponding positive terminal holes 1111*a* and negative terminal holes 1111*b*.

As discussed, when the cable connectors 7 are inserted into the accommodation portion S2 of the main body 110 of the cable concentrator 1, the cable connectors 7 can be restrained and held by the holding portions 153 of the elastic holding arm 150, and the cable connectors 7 can be divided into two groups by the partition portion 131 of the ground partition plate 130 and will not lean towards each other. Meanwhile, the cable connectors 7 in each group can be separated from each other by the ribs 1132 on the sidewall portion 113 of the main body 110 and therefore be correctly corresponding to the positive terminal holes 1111*a* and negative terminal holes 1111*b* formed on the bottom plate portion 111 of the main body 110, wherein a part of the cable connectors 7 also respectively correspond to the through holes 1331 formed on the ground bent tabs 133 of the ground partition plate 130. In such an arrangement, the cable connectors 7 can be gathered into bundles using the cable concentrator 1 before being electrically connected to the positive terminals 910 and the negative terminals 920 of the circuit board 9, and then all of the cable connectors 7 can be precisely and correctly electrically connected to the corresponding positive terminals 910 and negative terminals 920 in one step by simply inserting the cable concentrator 1 with the bundles of the cable connectors 7 into the accommodation space S1 of the container 8. During the insertion, the negative terminals 920 respectively penetrate through the through holes 1331 of the ground bent tabs 133 of the ground partition plate 130 and directly contact with the ground partition plate 130, such that all of the negative terminals 920 are grounded by the ground bent tabs 133 of the ground partition plate 130.

Accordingly, with the cable concentrator 1 of the above embodiment, the cable connectors 7 can be firstly gathered into bundles and arranged in a specific arrangement mating that of the terminals on the circuit board 9 (i.e., the positive terminals 910 and the negative terminals 920) and then to be inserted into the corresponding positive terminals 910 and negative terminals 920 once, which greatly improves the convenience of signal line installation. Also, in the cable concentrator 1, in addition to the function of separating and supporting the cable connectors 7, the ground partition plate 130 can be electrically connected to the cable connectors 7 electrically connected to the negative terminals 920 and thus grounding the negative terminals 920, which can reduce or eliminate the signal interference among the cable connectors 7 and therefore improve the quality of signal transmission. In short, the cable concentrator 1 of the above embodiment can greatly improve the installation efficiency of signal lines and help improve the quality of signal transmission.

Figure 6:
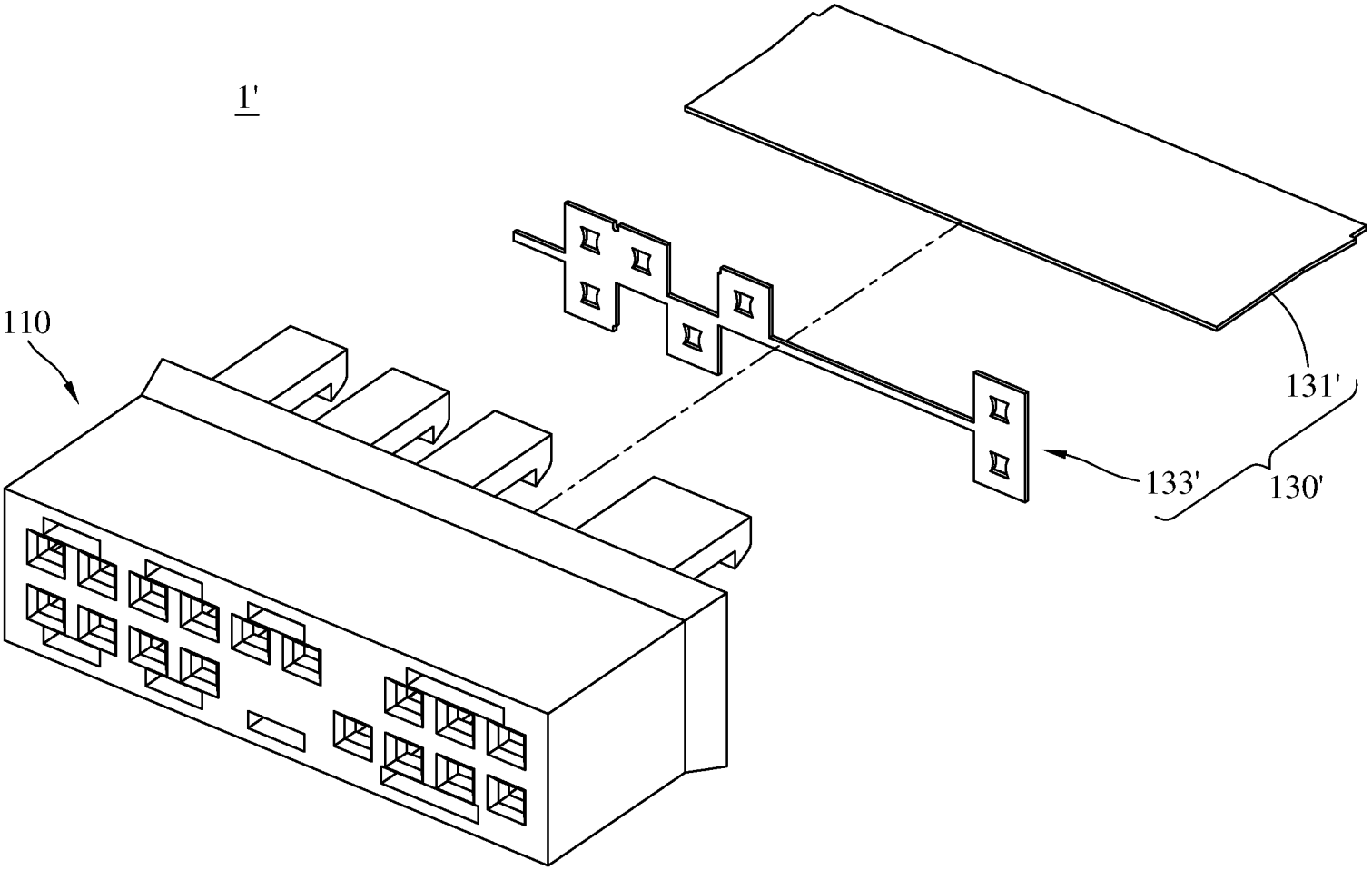
FIG. 6 is an exploded view of a cable concentrator according to another embodiment of the disclosure.

Note that the ground partition plate 130 in the cable concentrator 1 is one of the exemplary embodiments of the disclosure and does not intend to limit the disclosure. For example, please refer to FIG. 6, there is shown an exploded view of a cable concentrator 1' according to another embodiment of the disclosure, it is noted that the main difference between the cable concentrator 1' and the cable concentrator 1 of the previous embodiments is the configuration of the ground partition plate, thus only the differences between these two embodiments will be described in the following paragraphs, and the similar or same parts of them can be referred to the preceding descriptions and will not be repeated hereinafter.

As shown, in this embodiment, the cable concentrator 1' includes a ground partition plate 130' having a partition portion 131' and a plurality of ground bent tabs 133', where the partition portion 131' and the ground bent tabs 133' are two independent sheets. Specifically, the partition portion 131' and the ground bent tabs 133' each are an integrally-formed metal sheet, and these metal sheets can be electrically connected by welding, adhesive, or direct contact. In such an arrangement, the ground partition plate 130' can still be electrically connected to the negative terminals 920 to achieve the purpose of improving the quality of single transmission. Meanwhile, the sheet of the ground bent tabs 133' is independent of the partition portion 131', such that it is possible to form more than one pair of ground bent tabs 133' that are directly located opposite to each other, allowing the adjacent positive terminal and negative terminal to be inserted into the ground bent tabs 133'.

Figure 7:
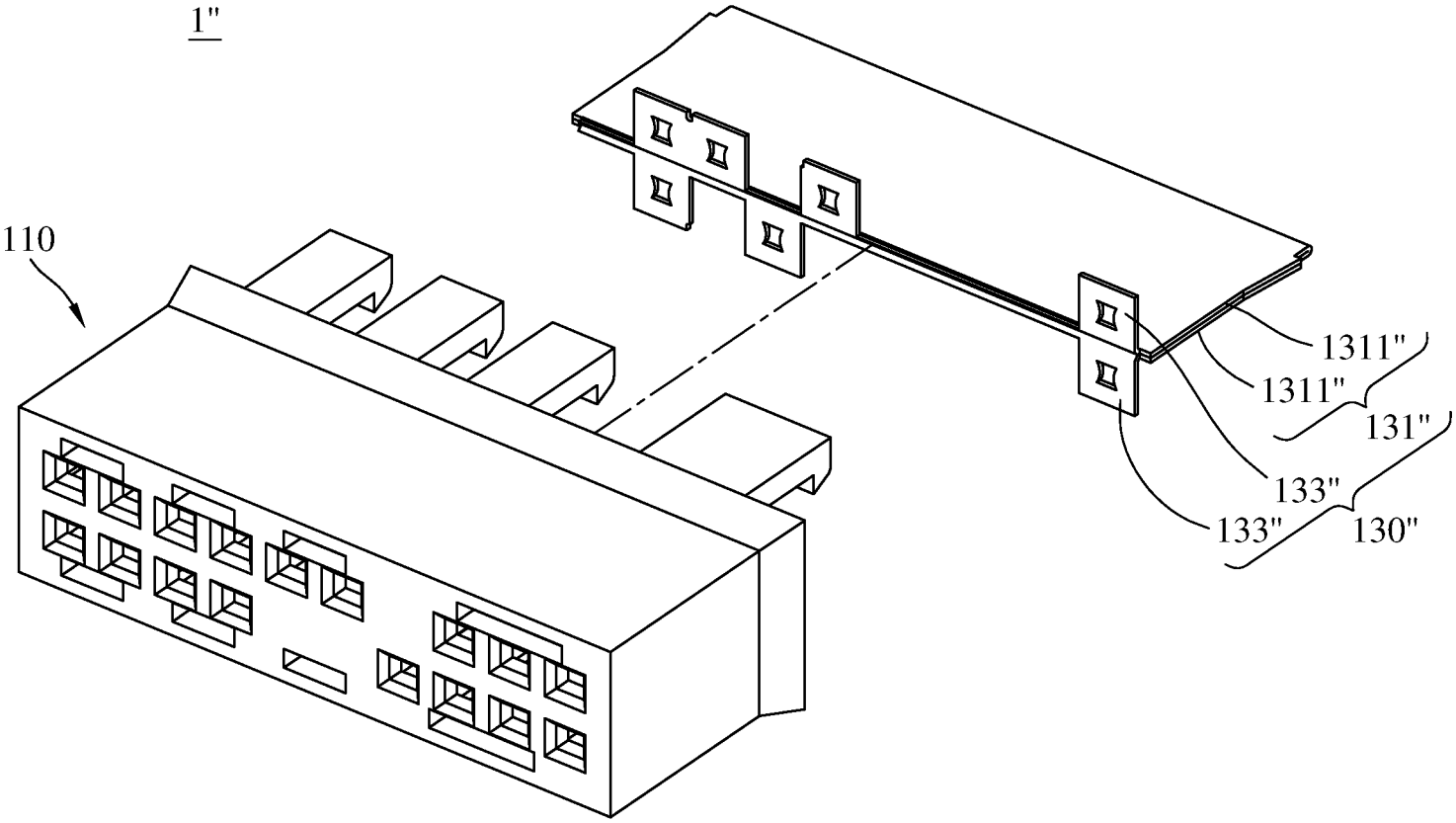
FIG. 7 is an exploded view of a cable concentrator according to still another embodiment of the disclosure.

Alternatively, referring to FIG. 7, there is shown an exploded view of a cable concentrator 1" according to still another embodiment of the disclosure, it is noted that the main difference between the cable concentrator 1" and the cable concentrator 1 of the previous embodiments is the configuration of the ground partition plate, thus only the differences between these two embodiments will be described in the following paragraphs, and the similar or same parts of them can be referred to the preceding descriptions and will not be repeated hereinafter.

As shown, in this embodiment, the cable concentrator 1" includes a ground partition plate 130" folded in half so that the ground partition plate 130" includes a partition portion 131" having two sheet bodies 1311" stacked on each other; the ground partition plate 130" includes a plurality of ground bent tabs 133" integrally formed with the sheet bodies 1311". As shown, the partition portion 131" is formed by two layers of the sheet bodies 1311" so that it may be thicker than that of the ground partition plate in the previous embodiments to increase the overall structural strength. Note that the sheet bodies 1311' can be fixed to each other by welding, adhesive, or direct contact. In such an arrangement, the ground partition plate 130" can still be electrically connected to the negative terminals 920 electrically connected to the cable connectors 7 to achieve the purpose of improving the quality of single transmission. Meanwhile, there are two sheet body 1311" stacked on each other to form the ground partition plate 130", such that it is possible to form more than one pair of ground bent tabs 133" that are directly located opposite to each other, allowing the adjacent positive terminal and negative terminal to be inserted into the ground bent tabs 133"

According to the cable concentrator and the electronic device having the same as discussed in the above embodiments, the cable connectors can be installed in the cable concentrator and then electrically connected to the terminals on the circuit board along with the cable concentrator, which greatly improves the convenience of signal line installation. Also, in the cable concentrator, the ground partition plate not only can divide the accommodation portion of the main body and separate and support the cable connectors but also have ground bent tabs corresponding to the negative terminal holes formed on the main body to ground the negative terminals of the circuit board, thereby reducing or eliminating the signal interference among the cable connectors and therefore further improving the quality of signal transmission.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. An electronic device, configured for insertion of a plurality of cable connectors, the electronic device comprising:

a circuit board, comprising a plurality of positive terminals and a plurality of negative terminals;

a container, disposed on the circuit board and having an accommodation space, the plurality of positive terminals and the plurality of negative terminals located in the accommodation space; and a cable concentrator, comprising:

a main body, detachably disposed in the accommodation space, wherein the main body comprises a plurality of sidewall portions and a bottom plate portion, the plurality of sidewall portions are connected to the bottom plate portion and the plurality of sidewall portions and the bottom plate portion together form an accommodation portion configured to accommodate the plurality of cable connectors, the bottom plate portion has a plurality of positive terminal holes respectively for insertions of the plurality of positive terminals and a plurality of negative terminal holes respectively for insertions of the plurality of negative terminals; and a ground partition plate, located in the accommodation portion and comprising a partition portion and a plurality of ground bent tabs, wherein the partition portion divides the accommodation portion of the main body, the plurality of ground bent tabs are connected to a side of the partition portion, the plurality of ground bent tabs respectively correspond to the plurality of negative terminal holes of the bottom plate portion and are electrically connected to the plurality of negative terminals, grounding the plurality of negative terminals.

2. The electronic device according to claim 1, wherein the plurality of ground bent tabs each have a through hole, the through holes of the plurality of ground bent tabs respectively correspond to the plurality of negative terminal holes of the bottom plate portion of the main body.

3. The electronic device according to claim 2, wherein the through holes of the plurality of ground bent tabs are at least smaller than the plurality of negative terminal holes of the bottom plate portion of the main body in diameter.

4. The electronic device according to claim 1, wherein the partition portion and the plurality of ground bent tabs are integrally formed with each other.

5. The electronic device according to claim 1, wherein the partition portion and the plurality of ground bent tabs are two sheets independent of each other.

6. The electronic device according to claim 4, wherein the partition portion comprises two sheet bodies stacked on each other, and the plurality of ground bent tabs are connected to a side of the sheet bodies.

7. The electronic device according to claim 1, wherein at least a part of the plurality of sidewall portions of the main body each have at least one rib located in the accommodation portion and configured to separate the plurality of cable connectors adjacent to each other.

8. The electronic device according to claim 7, wherein a length of at least a part of the ribs is smaller than a depth of the accommodation portion.

9. The electronic device according to claim 1, wherein the cable concentrator further comprises a plurality of elastic holding arms, the plurality of elastic holding arms each comprises an extension portion and a holding portion; in each of the plurality of elastic holding arms, the extension portion extends outwards from a side of the plurality of sidewall portions away from the bottom plate portion, the holding portion is connected to the main body via the extension portion and extends inwards from the extension portion, and the holding portion is configured to stop at a side of the plurality of cable connectors away from the bottom plate portion.

10. The electronic device according to claim 1, wherein the bottom plate portion has a plurality of guiding inclined surfaces forming ends of the plurality of positive terminal holes and ends of the plurality of negative terminal holes.

11. A cable concentrator, configured for insertion of a plurality of cable connectors, the cable concentrator comprising:

a main body, comprising a plurality of sidewall portions and a bottom plate portion, the plurality of sidewall portions connected to the bottom plate portion and the plurality of sidewall portions and the bottom plate portion together forming an accommodation portion configured to accommodate the plurality of cable connectors, the bottom plate portion having a plurality of positive terminal holes and a plurality of negative terminal holes; and a ground partition plate, located in the accommodation portion and comprising a partition portion and a plurality of ground bent tabs, wherein the partition portion divides the accommodation portion of the main body, the plurality of ground bent tabs are connected to a side of the partition portion and respectively correspond to the plurality of negative terminal holes of the bottom plate portion, wherein the plurality of ground bent tabs each have a through hole, the through holes of the plurality of ground bent tabs respectively correspond to the plurality of negative terminal holes of the bottom plate portion of the main body.

12. The cable concentrator according to claim 11, wherein the through holes of the plurality of ground bent tabs are at least smaller than the plurality of negative terminal holes of the bottom plate portion of the main body in diameter.

13. The cable concentrator according to claim 11, wherein the partition portion and the plurality of ground bent tabs are integrally formed with each other.

14. The cable concentrator according to claim 11, wherein the partition portion and the plurality of ground bent tabs are two sheets independent of each other.

15. The cable concentrator according to claim 13, wherein the partition portion comprises two sheet bodies stacked on each other, and the plurality of ground bent tabs are connected to a side of the sheet bodies.

16. The cable concentrator according to claim 11, wherein at least a part of the plurality of sidewall portions of the main body each have at least one rib located in the accommodation portion and configured to separate the plurality of cable connectors adjacent to each other.

17. The cable concentrator according to claim 16, wherein a length of at least a part of the ribs is smaller than a depth of the accommodation portion.

18. The cable concentrator according to claim 11, further comprising a plurality of elastic holding arms, wherein the plurality of elastic holding arms each comprises an extension portion and a holding portion; in each of the plurality of elastic holding arms, the extension portion extends outwards from a side of the plurality of sidewall portions away from the bottom plate portion, the holding portion is connected to the main body via the extension portion and extends inwards from the extension portion, and the holding portion is configured to stop at a side of the plurality of cable connectors away from the bottom plate portion.

19. The cable concentrator according to claim 11, wherein the bottom plate portion has a plurality of guiding inclined surfaces forming ends of the plurality of positive terminal holes and ends of the plurality of negative terminal holes.

* * * * *